US005430904A

United States Patent [19]

Ono et al.

[11] Patent Number: 5,430,904

[45] Date of Patent: Jul. 11, 1995

[54] PAINT FILM TRANSFER DEVICE

[75] Inventors: Masahiko Ono; Yoshinobu Yamashita, both of Osaka, Japan

[73] Assignee: Fujicopian Co., Ltd., Japan

[21] Appl. No.: 211,376

[22] Filed: Mar. 30, 1994

[30] Foreign Application Priority Data

| | | | |
|---|---|---|---|
| Oct. 2, 1991 | [JP] | Japan | 3-80102 U |
| Dec. 26, 1991 | [JP] | Japan | 3-107119 U |
| Dec. 26, 1991 | [JP] | Japan | 3-107120 U |
| Dec. 26, 1991 | [JP] | Japan | 3-343763 |

[51] Int. Cl.[6] ..... B43L 19/00; B65H 35/07

[52] U.S. Cl. ..... 15/104.94; 15/3.53; 118/257; 400/695; 156/577

[58] Field of Search ..... 15/104.94, 3.53, 424, 15/425, 3; 118/257; 400/695, 696, 700; 156/577

[56] References Cited

U.S. PATENT DOCUMENTS

| | | | |
|---|---|---|---|
| 2,851,008 | 9/1958 | Rochester | 400/696 |
| 3,308,002 | 3/1967 | Hurwich et al. | 156/577 |
| 3,969,181 | 7/1976 | Seabold | 156/577 |
| 4,671,687 | 6/1987 | Tamai | 15/104.94 |

FOREIGN PATENT DOCUMENTS

| | | | |
|---|---|---|---|
| 0263926 | 4/1988 | European Pat. Off. . | |
| 0377085 | 7/1990 | European Pat. Off. . | |
| 0551522 | 7/1993 | European Pat. Off. . | |
| 1090997 | 10/1960 | Germany . | |
| 3834374 | 4/1990 | Germany | 15/104.94 |
| 63-56690 | 4/1988 | Japan | 15/104.94 |
| 3128299 | 5/1991 | Japan | 15/104.94 |
| 3152059 | 6/1991 | Japan | 15/104.94 |

*Primary Examiner*—Edward L. Roberts, Jr.

*Attorney, Agent, or Firm*—Webb Ziesenheim Bruening Logsdon Orkin & Hanson

[57] ABSTRACT

An instrument for transferring coating film onto a surface requiring transfer printing. An instrument of this invention for transferring coating film is in such a structure that: a transfer head (4) is composed of a pressing body (4A) having a tape pressing surface (**4*a*) roughly equal in width to the transfer tape (2) and of a pair of right and left side plates (4B) in contact with the transfer tape for controlling widthwise movement of the transfer tape part which is in contact with the tape pressing body (4A); the tape pressing surface (4*a*) of the tape pressing body (4A) and front edges (4*b*) of the side plates (4B) are adapted to be continuous or almost continuous in the direction of the width of tape; and each of front edges (4*b*) of the side plates (4B) is formed tapered so as to gradually depart from an imaginary straight line (X) passing through the tape pressing surface (4*a***) toward outer sides in the width direction of the tape; whereby the instrument exhibits high transfer printing function and is easy to operate because no damage is inflicted to the surface requiring transfer printing even when the case tilts.

20 Claims, 13 Drawing Sheets

PAINT FILM TRANSFER DEVICE

INDUSTRIAL FIELD

The present invention relates to a paint film transfer device for use in easy coating and erasing of characters and pictures formed on a receiving surface such as of recording paper, or conversely in easy formation of characters and pictures on a receiving surface, and more particularly to a paint film transfer device including a case having an unused tape storage for feedably storing a transfer tape with transfer paint film formed on one surface of a backing material, and a transfer head for pressing on the backing material of the transfer tape fed from the unused tape storage out of the case to transfer the transfer paint film of the transfer tape to a receiving surface.

BACKGROUND ART

Conventionally, this type of paint film transfer device is constructed as shown in FIG. 23 (*a*), (*b*). Specifically, a transfer head 04 includes a tape presser 04A with a tape pressing surface 04*a* having approximately the same width as the transfer tape, and a pair of left and right side plates 04B for contacting and limiting sideways movement of a transfer tape portion contacting this tape presser 04A. Further, tip end surfaces 04*b* of the two side plates 04B are disposed in positions displaced upstream of the tape pressing surface 04*a* of the tape presser 04A with respect to a tape feeding direction.

This conventional paint film transfer device cannot limit, by contact, sideways movement of a transfer tape portion lying between the tip end surfaces 04*b* of the two side plates 04B and the tape pressing surface 04*a* of the tape presser 04A. Consequently, the transfer tape portion tends to move sideways relative to the tape pressing surface 04*a* when a sideways moving force is applied to the transfer tape. The relative sideways movement between the two pans may result in a displacement of a transfer position.

As a method of eliminating such an inconvenience, it is conceivable to extend the respective tip ends of the side plates 04B to an imaginary straight line extending in the direction of width of the tape through the tape pressing surface 04*a* of the tape presser 04A, so that the tip end surfaces 04*b* of the two side plates 04B and the tape pressing surface 04*a* of the tape presser 04A define a continuous plane in the direction of width of the tape.

In this case, however, the tip end surfaces 04*b* of the side plates 04B project to positions laterally outwardly of the tape pressing surface 04*a* although the transfer tape fed from the case may be guided to move to the tape pressing surface 04*a* while preventing its sideways displacement. Where, as shown in FIG. 24, a superposing transfer is made over a receiving surface A and a paint film 02*a* already transferred to the receiving surface A, a pressing force is applied to the case 01 to transfer a transfer paint film 02*a* of transfer tape 02 while compressing part of the transfer tape 02 and already transferred paint film 02*a*. If, at this time, the force is applied toward the transferred paint film 02*a* to tilt the case 01 in the direction of width of the tape toward the transferred paint film 02*a* (in the direction of "a" in the drawing), the corner edge of one of the side plates 04B projecting to the position laterally outwardly of the tape with respect to the tape pressing surface 04*a* cuts into the transferred paint film 02*a*. When the case

01 is moved in the cut-in condition, a new inconvenience arises in which part of the transferred paint film 02*a* is scraped off in stripe form. Incidently, reference 02*b* denotes a backing material.

On the other hand, a technique for improved transfer efficiency in which a pivot type transfer head is oscillatably connected to a main body of a transfer device is known from Patent Publication No. 3-11639 (U.S. Pat. No. 4,671,687).

With this technique, however, it is difficult to avoid nonuniformity of transfer when the transfer head is run in a tilted condition or where the surface is unsmooth in the tape running direction, since the transfer head fails to contact the transfer surface steadily due to lack of a restoring force of the transfer head. Moreover, in the case of superposing transfer, there arises an inconvenience that, due to the lack of restoring force of the transfer head, the transfer head is somewhat tilted forward to scrape off a transferred paint film with an end surface of the transfer head.

Furthermore, a technique in which a transfer head is elastically deformable is known from U.S. Pat. No. 4,851,976.

However, although this technique is capable of following broadly undulating surfaces, it cannot follow fine irregularities, hence a difficulty to avoid nonuniformity of transfer.

Thus, the conventional paint film transfer devices are not necessarily easy to handle from the point of view of transfer efficiency.

DISCLOSURE OF THE INVENTION

Having regard to the state of the art noted above, an object of the present invention is to provide a paint film transfer device easy to handle, with an improved transfer efficiency of the paint film transfer device, in easy coating and erasing of characters and pictures formed on a receiving surface such as of recording paper.

Specifically, for example, the invention intends to prevent a sideways displacement of a transfer tape portion contacting a tape pressing surface to secure steady running without allowing the tape to meander, and to inhibit scraping-off of the transferred paint film at a time of superposing transfer to enable the superposing transfer reliably, thereby to improve transfer efficiency.

Another object of the present invention is to provide a paint film transfer device in which a friction structure of a friction member mounted for interlocking a feed core and a takeup core is devised to facilitate uniforming of a tape feeding force from beginning of use of transfer tape to end of use, and moreover to suppress noise during use to stabilize a winding force, thereby to improve transfer efficiency.

A further object of the present invention is to provide a paint film transfer device in which a transfer tape feeding structure is devised to set a slip torque to a small value to enable use with a light operating force, and to check unnecessary unwinding of transfer tape from a feed core and reduce a final pressing force when pressing of a transfer head toward a transfer receiving surface is removed to separate the transfer tape from the transfer surface, thereby to improve transfer efficiency.

A further object of the present invention is to provide a paint film transfer device having an elastic portion capable of reliably following fine irregularities of a transfer receiving surface, thereby to improve transfer efficiency.

In order to fulfill the above objects, a paint film transfer device according to the present invention is characterized by having, mounted in a case, an unused tape storage for feedably storing a transfer tape having a transfer paint film formed on one surface of a backing material, and a transfer head for pressing on the backing material of the transfer tape fed from the unused tape storage out of the case to transfer the transfer paint film of the transfer tape to a receiving surface, wherein said transfer head includes a tape presser having a tape pressing surface of a width approximately corresponding to a width of said transfer tape, and a pair of left and right side plates for limiting sideways movement of a transfer tape portion contacting the tape presser, the tape pressing surface of said tape presser and tip end surfaces of said side plates defining a continuous or nearly continuous surface extending in a direction of width of the tape, the tip end surfaces of said side plates being inclined laterally outwardly of the tape and away from an imaginary straight line extending in the direction of width of the tape through said tape pressing surface.

This provides the following functions and effects.

Sideways movement of the transfer tape fed from the unused tape storage outwardly of the case may be limited by the pair of left and right side plates extending to, or to the vicinity of, the tape pressing surface of the tape presser.

When a superposing transfer is made over the receiving surface and a paint film already transferred to the receiving surface, even if a force is applied toward the transferred paint film to tilt the case in the direction of width of the tape toward the transferred paint film, the edge of one of the side plates projecting to the outward positions laterally of the tape with respect to the tape pressing surface does not cut into the transferred paint film, or cuts into the transferred paint film only by a greatly reduced amount, since the tip end surfaces are inclined away from the receiving surface as noted above.

Thus, it is now possible not only to inhibit a displacement of a paint film transfer position due to a relative movement in the direction of width of the tape between the tape pressing surface and the transfer tape portion contacting the same, but also to inhibit scraping off in stripe form of a transferred paint film effectively during superposing transfer.

The present invention may be constructed as follows. That is, said transfer head is inflexibly and rigidly fixed to said case, and an elastic pressing portion elastically deformable under a pressing force applied during transfer is provided at least in a position corresponding to the tape pressing surface of said transfer head.

This construction advantageously provides the following functions and effects.

When the transfer tape portion contacting the position corresponding to the tape pressing surface of the transfer head is pressed on a transfer position of the receiving surface, the position corresponding to the tape pressing surface of the transfer head may be slightly tilted in the direction of width of the tape relative to the receiving surface, whereby one end of the transfer tape in the direction of width of the tape contacting the position corresponding to the tape pressing surface comes into contact first. Even so, the pressing force application to the case may be continued. Then, a compressive deformation occurs to the elastic pressing portion formed in the position corresponding to the tape pressing surface of the transfer head. And the entire transfer paint film on the portion of the transfer tape contacting the position corresponding to the tape pressing surface is pressed against the receiving surface.

In a situation where the receiving surface is unsmooth or the receiving surface is slightly curved, a part in the direction of width of the tape of the portion of the transfer tape contacting the position corresponding to the tape pressing surface first contacts a bulge or a ridge of the curve of the receiving surface. If the pressing force is continuously applied to the case in this state, the elastic pressing portion formed on the position corresponding to the tape pressing surface of the transfer head becomes compressed and deformed. And the entire transfer paint film on the portion of the transfer tape contacting the elastic pressing portion is pressed against the receiving surface.

Thus, since the transfer head itself is inflexibly and rigidly fixed to the case, a special stopper structure is unnecessary as required where the transfer head is adapted elastically flexible relative to the case. The head mounting structure may be simplified accordingly. And yet, the elastic pressing portion formed on the position corresponding to the tape pressing surface of the transfer head is effective to inhibit a defective transfer due to uneven contact of the position corresponding to the tape pressing surface of the transfer head, and a defective transfer due to slight unsmoothness or slight curvature of the receiving surface.

Further, the present invention may be constructed as follows. That is, there are provided a feed core on which the transfer tape is wound, a feed rotation member rotatable with said feed core, a takeup core for taking up said transfer tape fed from said feed core, a takeup rotation member rotatable with said takeup core, and an interlock mechanism for interlocking and rotating said feed core and said takeup core with the takeup core having a takeup peripheral speed greater than a feeding peripheral speed of said feed core, said interlock mechanism having a friction member sandwiched between said feed core and said feed reel interlocked with said takeup core and supported on a common axis to impart a frictional force to interlock and rotate these rotation members, and the feed core being rotatable relative to said feed reel and said takeup core through slipping between said friction member and said feed rotation member or said feed reel and said takeup core or both, said friction member being sandwiched to contact opposed surfaces of said feed core or said feed reel and said takeup core or both, linearly in radial directions and in a plurality of positions circumferetially thereof.

This construction advantageously provides the following functions and effects.

The friction member contacts opposed surfaces of the feed core or feed reel acting as a feeding rotation member and the takeup core or both over smaller areas than in the prior art, and besides contacts along radial directions in a plurality of positions in the circumferential direction. Even if a distribution of frictional conditions circumferentially of the friction member and feeding rotation member or feed reel and takeup core is varied with the different components, and even at start of use or at finish of use of the transfer tape, the coefficient of friction is unlikely to vary, so that torque transmission for relative rotation between these rotation members is little variable from product to product.

Moreover, since the friction member contacts the opposed surfaces of the feeding rotation member or feed reel and the takeup core or both along radial directions in a plurality of positions in the circumferential direction, without being pressed by the two rotation members in positions between adjacent contact portions circumferentially thereof, distortion produced in the friction member is released with ease, and the distortion causing noise is not readily accumulated when the feed rotation member and feed reel are starting to rotate relative to the takeup core.

Thus, the take feeding performance of the product may readily be uniformed, and noise tends to be suppressed during use.

Further, the present invention may be constructed as follows. That is, a rotation stopper for stopping rotation of said feed core is provided to be movable between a rotation allowing position to allow rotation of said feed core and a rotation stopping position to stop rotation thereof, and an interlock mechanism is provided to move said rotation stopper to the rotation allowing position in response to a pressing operation of said transfer head toward said receiving surface upon start of a transfer operation, and to move said rotation stopper to the rotation stopping position in response to a release operation to release the pressure of the transfer head toward the receiving surface.

This construction provides the following functions and effects.

The rotation stopper is moved to the rotation allowing position in response to pressing of the transfer head toward the receiving surface to press the transfer tape upon the receiving surface. When, the transfer head is moved in this state, the transfer tape becomes unwound while forcibly rotating the feed core, and at the same time the used transfer tape having the paint film transferred by the transfer head is taken up, without relaxing, on the takeup core.

After completion of a series of transfer operations, the rotation stopper is moved to the rotation stopping position in response to a pressure releasing operation of the transfer head to release the pressing force of the transfer head toward the receiving surface to move the transfer tape away from the receiving surface. With the transfer tape moved away from the receiving surface, the feed core does not rotate even if the transfer tape wound on the feed core is pulled by the paint film transferred to the receiving surface. The paint film transferred to the receiving surface is tom off the paint film on the transfer tape.

Thus, even where a small slip torque is selected to enable use with a light operating force, there is little chance of the transfer tape being fed unnecessarily from the feed core upon release of the pressing force of the transfer head toward the receiving surface to move the transfer tape away from the receiving surface.

BEST MODE FOR CARRYING OUT THE INVENTION

Figure 1:
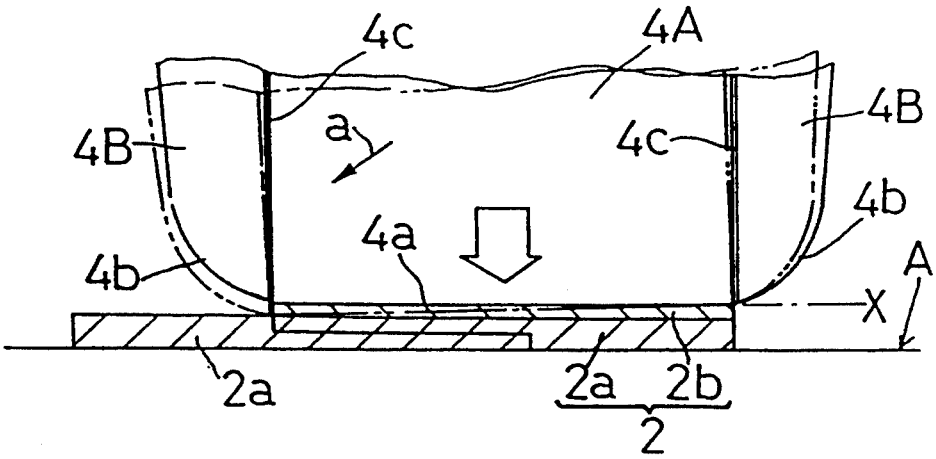
FIG. 1 is an enlarged front view of a transfer head for explaining a superposing transfer condition.
Figure 2:
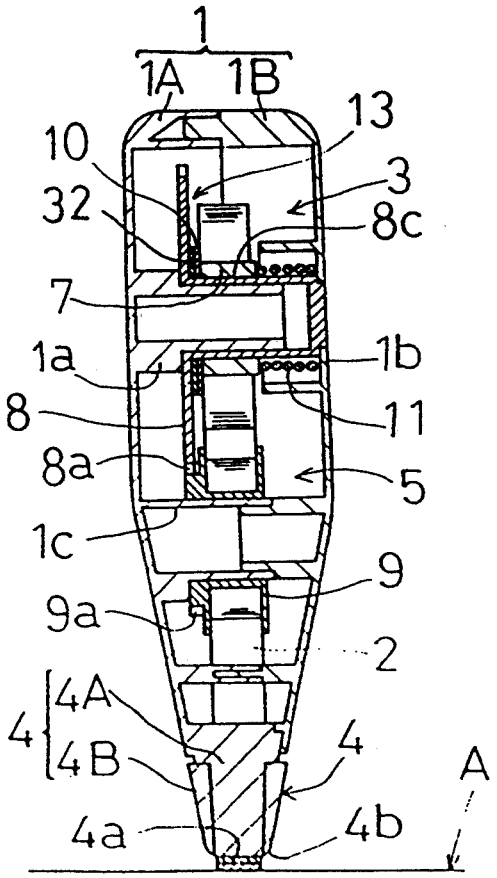
FIG. 2 is a view in cross section of an entire paint film transfer device.
Figure 3:
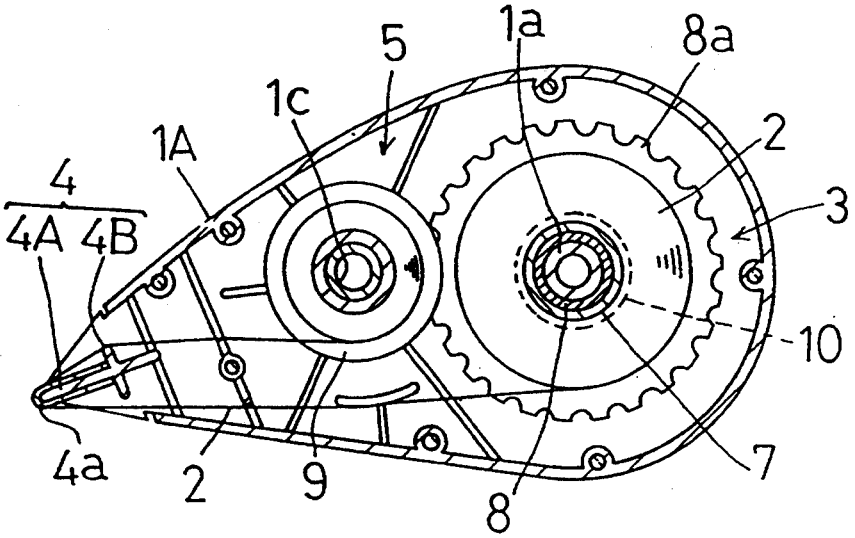
FIG. 3 is a view in vertical section of the entire paint film transfer device.

FIGS. 1–3 show a paint film transfer device. A two-part split type case 1 formed of plastic includes an unused tape storage 3 for feedably storing a transfer tape 2 having a transfer paint film 2*a* formed on one surface of a backing material 2*b*, a transfer head 4 for pressing on the backing material 2*b* of the transfer tape 2 fed from the unused tape storage 3 out of the case 1 to transfer the transfer paint film 2*a* of the transfer tape 2 to a receiving surface A such as of recording paper, and a used tape storage 5 for taking up and storing used transfer tape 2 in roll form.

The case 1 is comprised of a pair of split case portions 1A, 1B separably joined in a direction of width of the tape. The transfer head 4 is formed integral with a tip end of one of the split case portions 1A in an inflexible rigid state.

The transfer head 4 includes a plate-like tape presser 4A having a tape pressing surface 4*a* of a width approximately corresponding to a width of the transfer tape 2, and a pair of side plates 4B having an approximately triangular shape as seen in the direction of width of the tape. These tape presser 4A and pair of side plates 4B are formed integral to have an approximately H-shaped cross section.

The two side plates 4B have opposed surfaces 4c acting as limiting surfaces for limiting, through contact, sideways movement of a transfer tape portion contacting the tape presser 4A. Tip end surfaces 4b of the side plates 4B and the tape pressing surface 4a of the tape presser 4A define a continuous surface extending in the direction of width of the tape. Each of the tip end surfaces 4b of the side plates 4B is formed to be a curved surface inclined laterally outwardly of the tape and away from an imaginary straight line X extending in the direction of width of the tape through the tape pressing surface 4a.

The unused tape storage 3 includes a cylindrical feed core 7 for feedably supporting the transfer tape 2 in pancake form, and a feed reel 8 in the form of a tubular shaft for rotatably supporting the feed core 7. The feed reel 8 is supported to be only rotatable by and between a first tubular member 1a projecting from an inner wall of one of the split case portions 1A, and a recess 1b formed in an inner wall of the other split case portion 1B.

The used tape storage 5 includes a tubular takeup core 9 for taking up, in pancake form, the transfer tape 2 after use, which has passed through the tape pressing surface 4a of the transfer head 4. Further, this takeup core 9 is mounted on and supported to be only rotatable by a second tubular member 1c projecting from an inner wall of one of the split case portions 1A.

On the other hand, the feed reel 8 in the unused tape storage 3 has a large diameter gear 8a formed integral therewith and meshed with a small diameter gear 9a formed on the takeup core 9 in the used tape storage 5. A slip ring 10 friction member, such as formed of rubber, is interposed between opposed surfaces at one end of the feed reel 8 and feed core 7. Further, a coil spring 11 is interposed between the inner wall of the other split case portion 1B and the other end surface of the feed core 7 for elastically biasing the feed core 7 toward the slip ring 10.

Thus, with a frictional force of the feed core 7 and slip ring 10 and a frictional force of the slip ring 10 and feed reel 8, the takeup core 9 is driven to rotate with rotation of the feed core 7 when the transfer tape 2 is fed. Further, the takeup core 9 has a used tape winding peripheral speed greater than a tape feeding peripheral speed of the feed core 7, which is due to a gear ratio between the large diameter gear 8a and small diameter gear 9a.

The transfer paint film 2a of the transfer tape 2 is formed by suitably compounding a pigment, a binding agent, a dispersing agent and the like. The backing material 2b is formed of resin film such as of polyimide, polyester, polyethylene or the like, or paper film such as of condenser paper, glassine paper or the like.

When the transfer head 4 is moved along the receiving surface A, with the tape pressing surface 4a of the transfer head 4 pressing the transfer tape 2 on the receiving surface A, the transfer tape 2 is forcibly unwound from the feed core 7. After the transfer paint film 2a is transferred to the receiving surface A under pressure of the transfer head 4, the used transfer tape 2 having passed through the tape pressing surface 4a of the transfer head 4 is taken up reliably in a tight condition on the takeup core 9 driven and rotated by rotation of the feed core 7.

Where, as shown in FIG. 1, a superposing transfer is made over a receiving surface A and a paint film 2a already transferred to the receiving surface A, the pressing force applied to the case 1 transfers the transfer paint film 2a of the transfer tape 2 while compressing part of the transfer tape 2 and already transferred paint film 2a. Even if, at this time, the force is applied toward the transferred paint film 2a to tilt the case 1 in the direction of width of the tape (as shown in a phantom line in the drawing) toward the transferred paint film 2a (in the direction of "a" in the drawing), the edge of one of the side plates 4B (adjacent the already transferred paint film 2a) projecting to the outward position laterally of the tape with respect to the tape pressing surface 4a does not cut into the transferred paint film 2a or cuts into the transferred paint film 2a only by a small amount, since the tip end surfaces 4b are curved away from the receiving surface A as noted hereinbefore.

Figure 4:
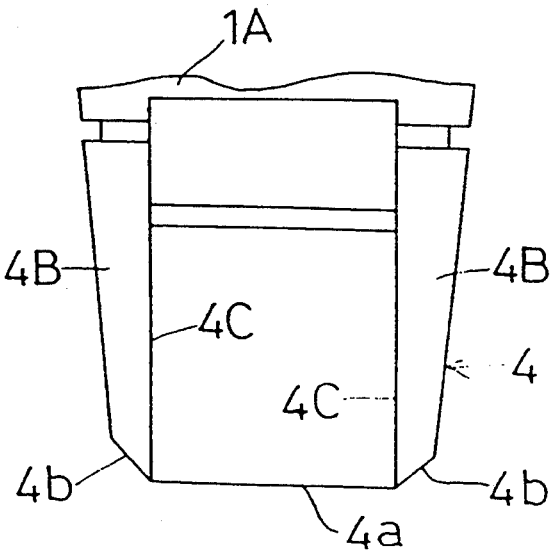
FIG. 4 is an enlarged front view of a transfer head in a different embodiment.

In the above embodiment, each of the tip end surfaces 4b of the side plates 4B is formed to be a curved surface inclined laterally outwardly of the tape and away from an imaginary straight line X extending in the direction of width of the tape through the tape pressing surface 4a. However, as shown in FIG. 4, a straight inclination or stepped inclination may be formed in practice.

In the above embodiment, the tip end surfaces 4b of the side plates 4B and the tape pressing surface 4a of the tape presser 4A define a continuous plane in the direction of width of the tape. However, the tip end surfaces 4b of the side plates 4B may be displaced from the tape pressing surface 4a of the tape presser 4A slightly upstream with respect to a tape feeding direction. In this case, an extent of displacement may be determined to be within a range capable of inhibiting a displacement of a paint film transfer position due to a relative movement in the direction of width of the tape between the tape pressing surface 4a and a transfer tape portion in contact therewith.

In the above embodiment, the case 1 houses the used tape storage 5 for taking up and storing used transfer tape 2. In practice, used transfer tape 2 may simply be cut and removed outside the case 1.

A different embodiment will be described hereinafter.

Figure 5:
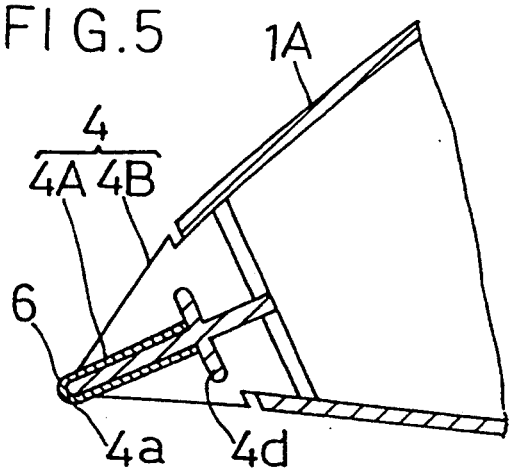
FIG. 5 is an enlarged sectional view of a transfer head of a paint film transfer device in a further embodiment.
Figure 6:
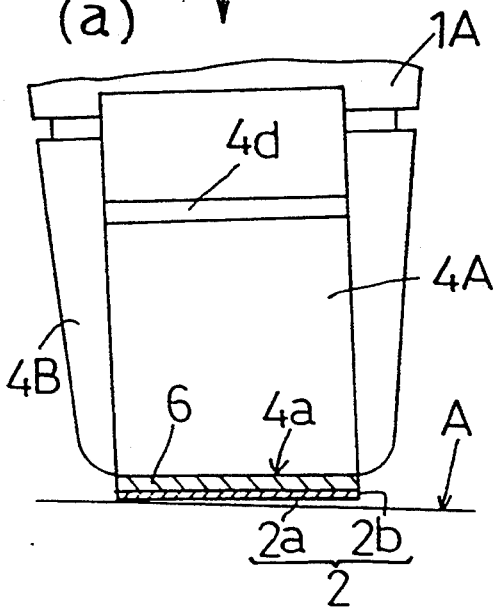
FIGS. 6 (*a*) , (*b*) are explanatory views of transfer conditions.
Figure 6:
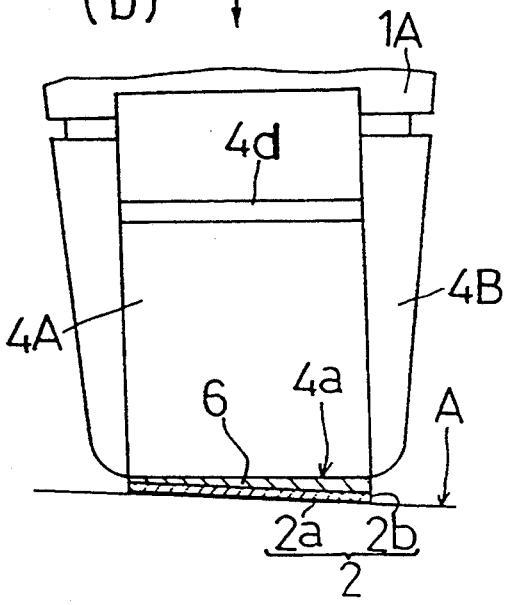

(a) As shown in FIGS. 5 and 6, the transfer head 4 includes a plate-like tape presser 4A having a rib 4d, and a pair of side plates 4B having an approximately triangular shape as seen in the direction of width of the tape. These tape presser 4A and pair of side plates 4B are formed integral to have an approximately H-shaped cross section. An outer surface of the tape presser 4A has an elastic pressing portion 6 formed on an outer surface portion thereof extending from a tip end position corresponding to the tape pressing surface 4a to the rib 4d, which is elastically deformable under a pressing force at a time of transfer.

The elastic pressing portion 6 is formed of an elastomer material such as plastic resin, natural rubber, synthetic rubber or the like. It is bonded to the outer surface of the tape presser 4A, fitted in a recess formed in the outer surface of the tape presser 4A, or formed integral with the outer surface of the tape presser 4A such as by press fitting, depositing or integrating.

When the transfer head 4 is moved along the receiving surface A, with the position corresponding to to the tape pressing surface 4a of the transfer head 4 pressing the transfer tape 2 on the receiving surface A, the transfer tape 2 is forcibly unwound from the feed core 7. The transfer paint film 2a is transferred to the receiving surface A under pressure of the transfer head 4.

At this time, as shown in FIG. 6 (*a*), the position corresponding to the tape pressing surface 4a of the transfer head 4 may be slightly tilted in the direction of width of the tape relative to the receiving surface A, whereby one end of the transfer tape 2 in the direction of width of the tape contacting the position corresponding to the tape pressing surface 4*a* comes into contact first. Even so, the pressing force application to the case 1 may be continued. Then, as shown in FIG. 6 (*b*) , a compressive deformation occurs to the elastic pressing portion 6 formed in a laminar form in the position corresponding to the tape pressing surface 4*a* of the transfer head 4. And the entire transfer paint film 2*a* on the portion of the transfer tape 2 contacting the position corresponding to the tape pressing surface 4*a* of the transfer head 4 is pressed against the receiving surface A.

In a situation where the receiving surface A is unsmooth or the receiving surface A is curved, a part in the direction of width of the tape of the portion of the transfer tape 2 contacting the position corresponding to the tape pressing surface 4*a* first contacts a bulge or a ridge of the curve of the receiving surface A. If the pressing force is continuously applied to the case 1 in this state, the elastic pressing portion 6 of the transfer head 4 becomes compressed and deformed. And the entire transfer paint film 2*a* on the portion of the transfer tape 2 contacting the position corresponding to the tape pressing surface 4*a* of the transfer head 4 is pressed against the receiving surface A.

The used transfer tape 2 having passed through the position corresponding to the tape pressing surface 4*a* of the transfer head 4 is taken up reliably in a tight condition by the takeup core 9 driven and rotated by rotation of the feed core 7.

Other embodiments will be described hereinafter.

Figure 7:
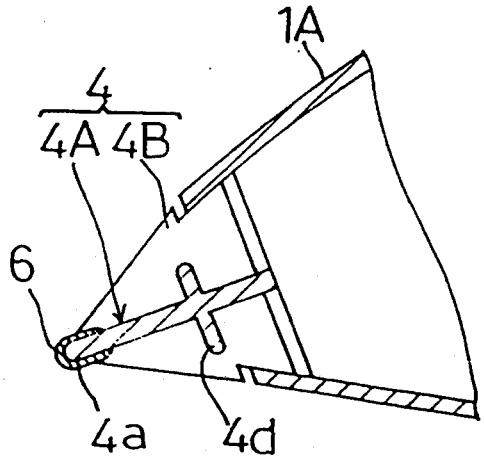
FIG. 7 is an enlarged sectional view of a transfer head in a still further embodiment.

(b) In the above embodiment, the outer surface of the tape presser 4A has the elastic pressing portion 6 formed in laminar form on the outer surface portion thereof extending from the tip end position corresponding to the tape pressing surface 4*a* to the rib 4*d*. As in the embodiment shown in FIG. 7 or in the embodiment shown in FIG. 8, the elastic pressing portion 6 may be formed only in the position corresponding to the tape pressing surface 4*a* of the tape presser 4A.

Figure 8:
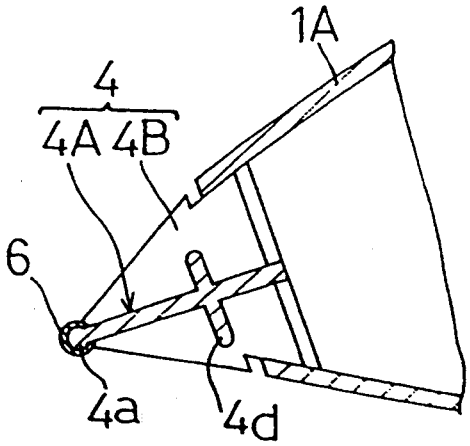
FIG. 8 is an enlarged sectional view of a transfer head in a still further embodiment.

In the embodiment shown in FIG. 8, the tip end of the tape presser 4A is formed cylindrical, and the elastic pressing portion 6 having a C-shaped cross section is secured to the cylindrical tip end by fitting means.

Figure 9:
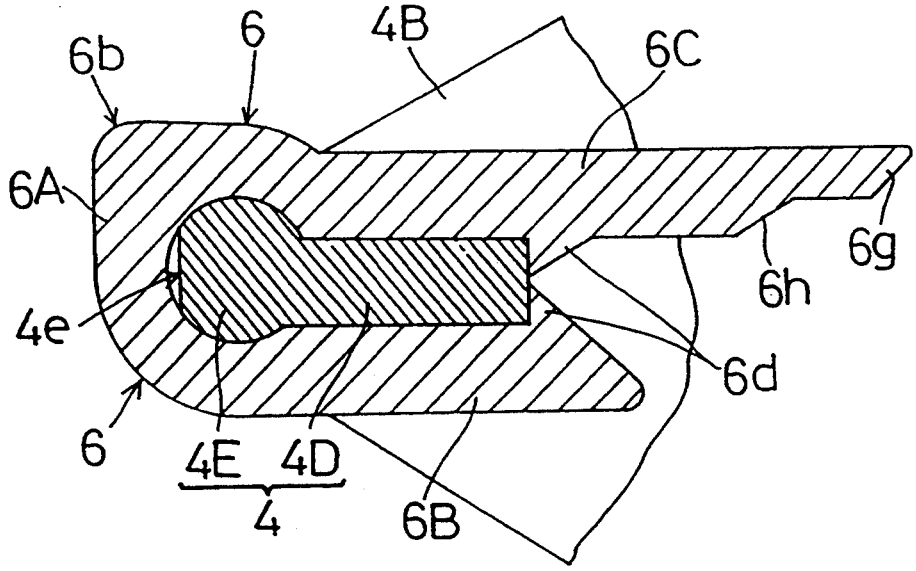
FIG. 9 is an enlarged sectional view of a transfer head in a still further embodiment.
Figure 10:
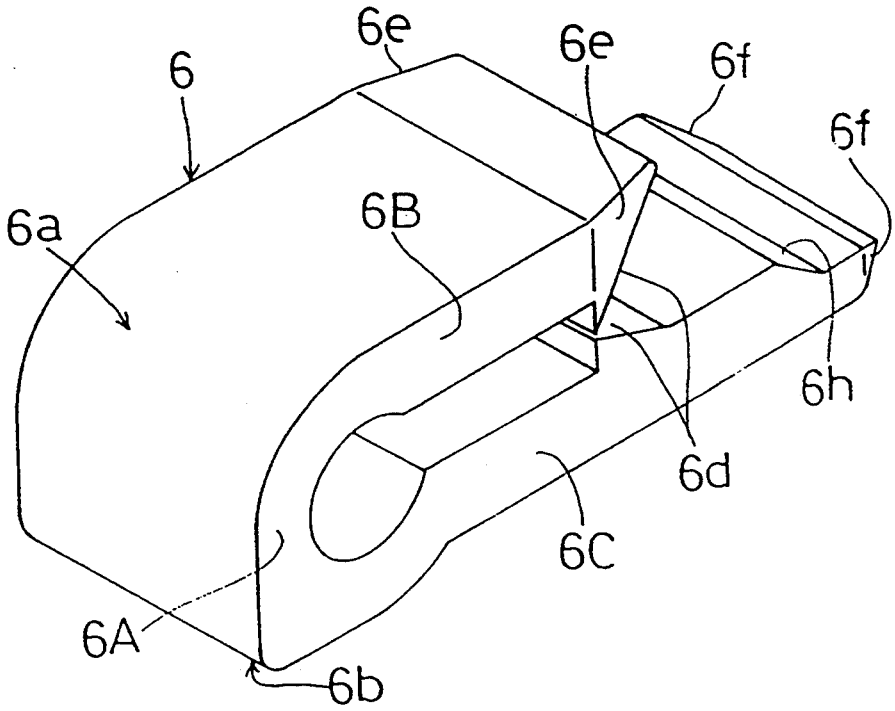
FIG. 10 is an enlarged perspective view of an elastic presser of the transfer head shown in FIG. 9.

(c) The embodiment shown in FIGS. 9 and 10 has a different fitting and fixing means for the elastic pressing portion 6. Here, the transfer head 4 includes a tip end 4E formed cylindrical and having a diameter slightly larger than a thickness of a plate-like proximal portion 4D continuous with the tip end 4E. The elastic pressing portion 6 is an integrally molded member including a tubular portion 6A having an approximately C-shaped vertical section for fitting on the cylindrical tip end 4E of the transfer head 4, a first side plate portion 6B extending from one end of the C-shaped tubular portion 6A along one side surface of the plate-like proximal portion 4D, and a second side plate portion 6C extending from the other end of the C-shaped tubular portion 6A along the other side surface of the plate-like-proximal portion 4D to a greater extent than the first side plate portion 6B. The elastic pressing portion 6 is fitted on the transfer head 4 from the cylindrical tip end 4E toward the plate-like proximal portion 4D.

The elastic pressing portion 6 includes two corner portions 6*a*, 6*b* on outer surfaces of the C-shaped tubular portion 6A, of which the second corner portion 6*b* continuous with the second side plate portion 6C defines an arcuate surface of smaller radius than the first corner portion 6*a* continuous with the first side plate portion 6C. Consequently, when the second corner portion 6*b* of the elastic pressing portion 6 is pressed hard on the backing material 2*b* of the transfer tape 2 immediately before completion of transfer, the pressing force concentrates on a linear area of contact between the second corner portion 6*b* and the backing material 2*b* of the transfer tape 2. Thus, the transfer paint film 2*a* corresponding to this area of contact is compressed linearly and pressed hard on the receiving surface A. The transfer paint film 2*a* is cut linearly along the position pressed by the second corner portion 6*b* in a reliably way. As a result, the transfer paint film 2*a* transferred to the receiving surface A exhibits a fine finish at a trailing end.

On the other hand, with the C-shaped tubular portion 6A of the elastic pressing portion 6 fitted on the cylindrical tip end 4E of the transfer head 4, the elastic pressing portion 6 is prevented from becoming disengaged from the transfer head 4. To ensure that the elastic pressing portion 6 is retained in place, a pair of engaging craws 6*d* having an approximately triangular vertical section are formed integral with opposed surfaces of the first side plate portion 6B and second side plate portion 6C for engaging an end surface of the plate-like proximal portion of the transfer head 4.

Further, the first side plate portion 6B includes opposite end corners 6*e* in the direction of width of the tape, and the second side plate portion 6C includes opposite end corners 6*f* in the direction of width of the tape, which define inclined surfaces, respectively. The second side plate portion 6C includes an end region having a reduced wall thickness than the other regions thereof. And an end surface 6*g* of the thin end region, and a stepped region 6*h* located at a boundary between the thin end region and thicker region, define inclined surfaces extending outwardly toward the end, respectively. In this way, the elastic pressing portion 6 is attachable to the transfer head 4 by an automatic attaching machine or the like with increased facility and assurance.

When attaching the elastic pressing portion 6 to the transfer head 4, it is necessary to assemble them with the second corner portion 6*b* disposed downstream with respect to a tape feeding direction. As means for determining the attaching posture of the elastic pressing portion 6, this embodiment provides the different lengths of the first side plate portion 6B and second side plate portion 6C of the elastic pressing portion 6 for determination purposes. Such determining means in particular is essential to attachment by an automatic attaching machine.

Further, the cylindrical tip end 4E of the transfer head 4 has a tip end defining a flat surface 4*e* having a width in the order of 0.6 mm. The backing material 2*b* of the transfer tape 2 corresponding to this flat surface 4*e* presses with a fiat surface having a width in the order of 1 mm.

In this embodiment, the elastic pressing portion 6 is fitted on the transfer head 4 from the cylindrical tip end 4E toward the plate-like proximal portion 4D. However, the elastic pressing portion 6 having the above configuration may be fitted and fixed to the transfer head 4 in the direction of width of the tape.

Figure 11:
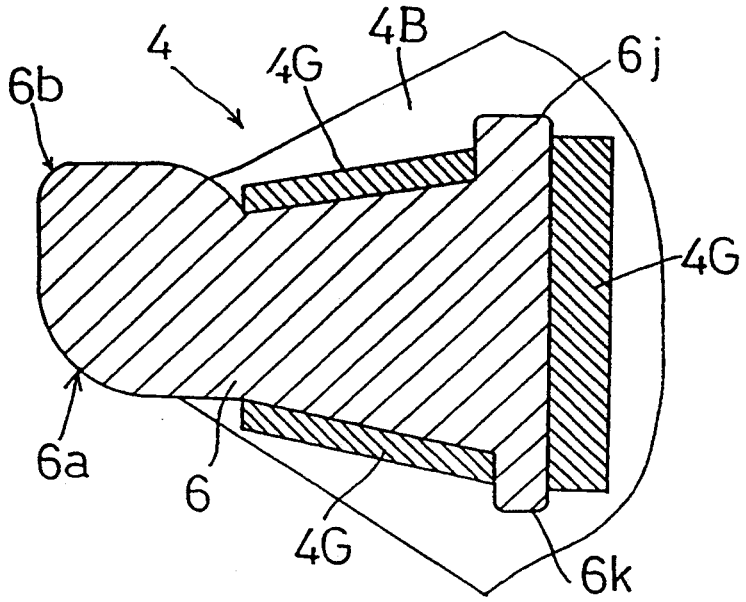
FIG. 11 is an enlarged sectional view of a transfer head in a still further embodiment.

(d) In the embodiment shown in FIG. 11, the transfer head 4 includes a pair of left and right side plates 4B, and three mounting plates 4G formed integral with one of the side plates 4B and arranged approximately in the shape of C with spaces thereamong. An elastic pressing portion 6 in the form of a bulge is fitted and secured to the three mounting plates 4G in the direction of width of the tape.

The elastic pressing portion 6 used in this embodiment has a tip end outer configuration substantially the same as the tip end outer configuration of the elastic pressing portion 6 used in the embodiment shown in FIG. 10. Thus, like reference numerals are used to identify like parts which will not be described again.

Further, in this embodiment, the elastic pressing portion 6 has a pair of engaging projections **6*j*, 6*k*, of which one engaging projection 6*j* has a larger width than the other engaging projection 6*k***.

That is, as in the embodiment shown in FIG. 10, an assembly posture is determined in this embodiment by differentiating the widths of the pair of engaging projections **6*j*, 6*k***.

(e) The surfaces of the elastic pressing portion 6 may be given a surface treatment of a low coefficient of friction to enhance its sliding relative to the transfer tape 2.

(f) In the above embodiments, the case 1 houses the used tape storage 5 for taking up and storing used transfer tape 2. In practice, used transfer tape 2 may simply be cut and removed outside the case 1.

Figure 12:
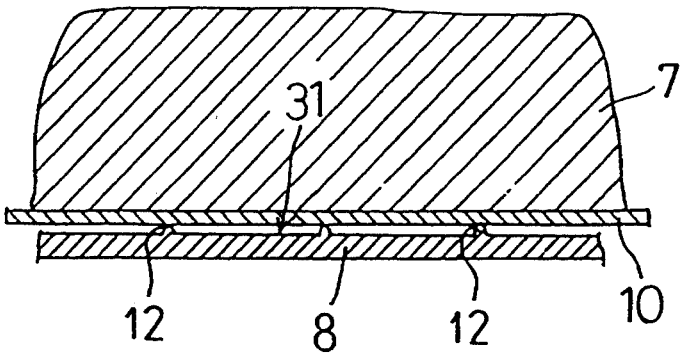
FIG. 12 is a sectional view taken on line C—C of FIG. 13.
Figure 13:
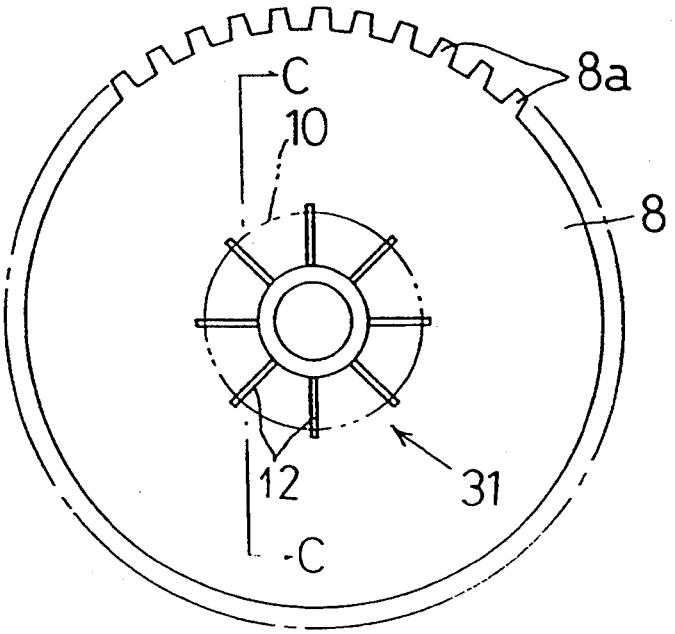
FIG. 13 is a plan view of a takeup rotation member.

(g) It is possible to construct as shown in FIGS. 2, 12 and 13. That is, this paint film transfer device includes a feed core 7 on which transfer tape 2 is wound, a feed rotation member rotatable with this feed core 7, a takeup core 9 for taking up the transfer tape 2 fed from the feed core 7, a takeup rotation member rotatable with the takeup core 9, and an interlock mechanism 13 for interlocking and rotating the feed core 7 and takeup core 9, with the takeup core 9 having a takeup peripheral speed greater than a feeding peripheral speed of the feed core 7. This interlock mechanism 13 has a friction member 10 sandwiched between the feed core 7 and the feed reel 8 interlocked with the takeup core 9 and supported on a common axis to impart a frictional force to interlock and rotate the feed core 7, the feed reel 8 and the takeup core 9, and to interlock the feed core 7 and takeup core 9, with the feed core 7 being rotatable relative to the feed reel 8 and takeup core 9 through slipping between the friction member 10 and feed core 7 or feed reel 8 and takeup core 9 or both 7, 8, 9. The friction member 10 is sandwiched to contact opposed surfaces 14, 31 of the feed core 7 or feed reel 8 and takeup core 9 or both 7, 8, 9, linearly in radial directions and in a plurality of positions circumferetially thereof.

That is, eight ridges 12 are formed to extend radially equidistantly on a surface 31 of the feed reel 8 opposed to the slip ring 10 acting as the friction member. The slip ring 10 is sandwiched to contact the feed reel 8 linearly along these ridges 12.

Figure 14:
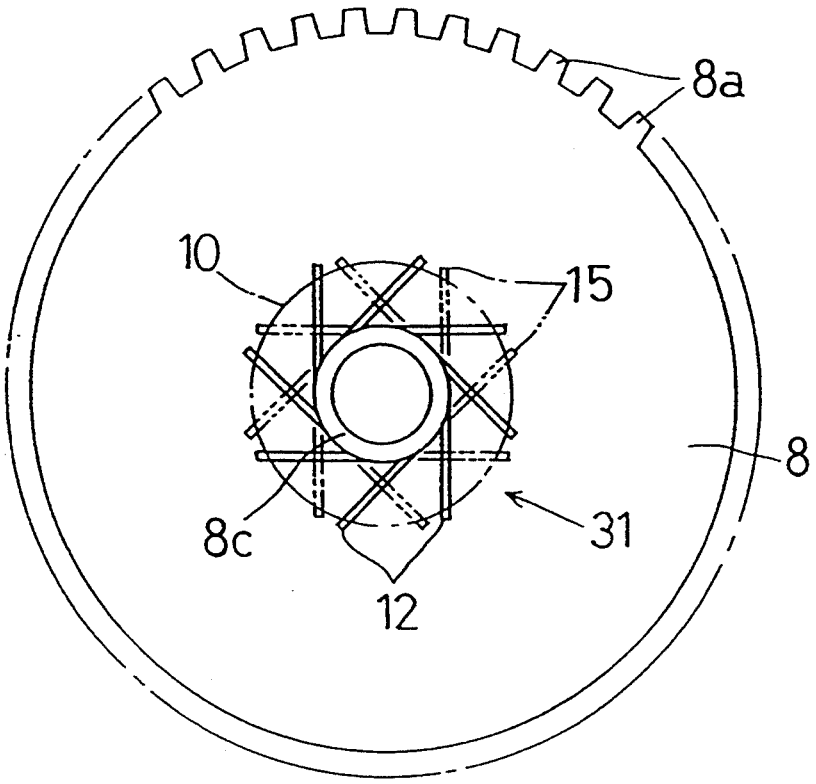
FIG. 14 is a plan view of a takeup rotation member in a further embodiment.
Figure 15:
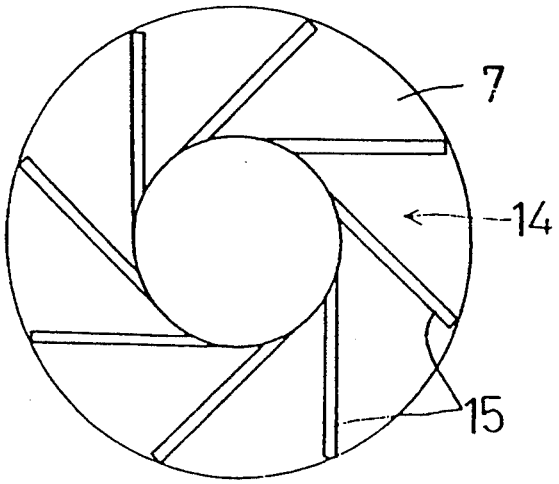
FIG. 15 is a plan view of a feed rotation member in a further embodiment.

(h) FIGS. 14 and 15 show an embodiment in which the paint film transfer device shown in the above embodiment has a slip ring 10 contacting both of the feed core 7 and feed reel 8 linearly along radial directions and in a plurality of positions circumferentially thereof. Ridges 15, 12 are formed to extend radially in tangential directions on a surface 14 of the feed core 7 opposed to the slip ring 10 and on a surface 31 of the feed reel 8 opposed to the slip ring 10, respectively. With the slip ring 10 sandwiched, the ridges 15 on the feed core 7 and the ridges 12 on the feed reel 8 intersect one another in plan view.

Other aspects are the same as in the foregoing embodiment.

Figure 16:
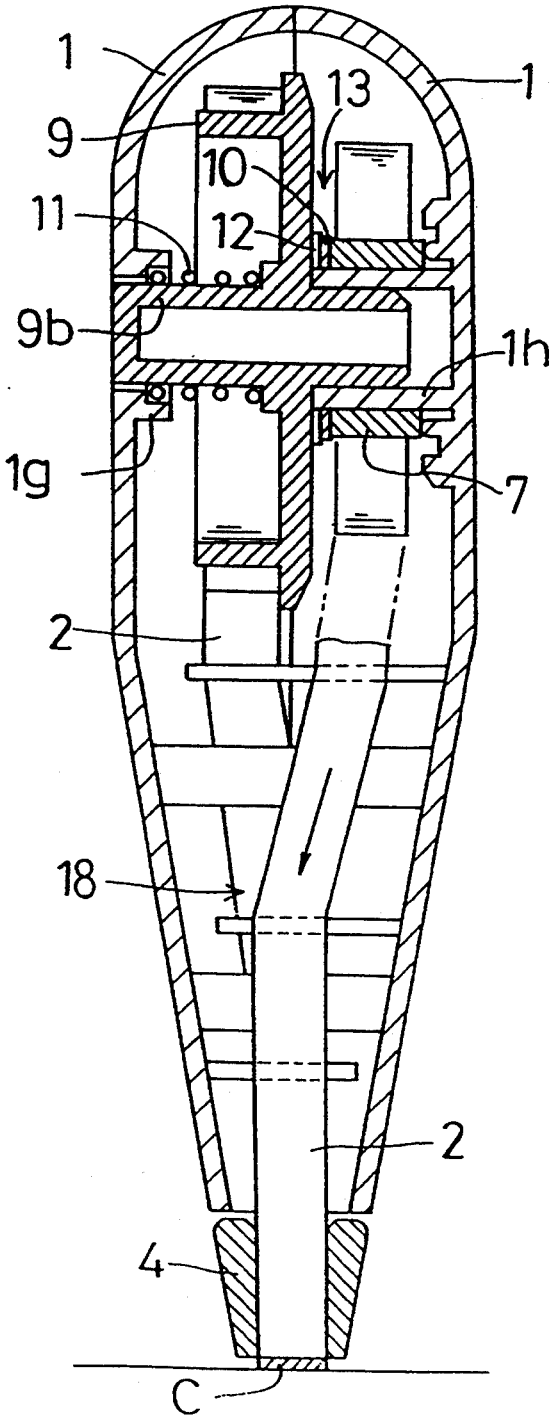
FIG. 16 is a sectional side view of a paint film transfer device in a still further embodiment.

(i) FIG. 16 shows a paint film transfer device for use in correcting prints and having a feed core 7 and a takeup core 9 supported on a common axis. A two-part split type case 1 formed of plastic includes the feed core 7 formed of plastic and having a pressure sensitive transfer tape 2 wound thereon, a transfer head 4 for pressing the transfer tape 2 fed from the feed core 7 to transfer the transfer paint film **2*a* to a receiving surface, the takeup core 9 formed of plastic for taking up the transfer tape 2 after transfer by the transfer head 4, and a guide section 18 for twisting and guiding the transfer tape 2 fed from the feed core 7 via the transfer head 4 to the takeup core 9**.

When the transfer head 4 is moved longitudinally of the tape, with the transfer head 4 pressing the transfer tape 2 on the receiving surface, the transfer tape 2 is forcibly unwound from the feed core 7, and the transfer paint film **2*a* under pressure of the transfer head 4 is transferred to the receiving surface. Then, the used transfer tape 2 is forcibly taken up in a tight condition by the takeup core 9**.

A structure for running the transfer tape 2 in this embodiment will be described next.

Two tubular shafts **1*g*, 1*h* are formed integral with inner walls of the case 1, with the feed core 7 rotatably mounted peripherally of the tubular shaft 1*h*. The takeup core 9 has shaft portions 9*b* thereof rotatably fitted in the two tubular shafts 1*g*, 1*h*, whereby the feed core 7 and takeup core 9 are coaxially supported in an overlapping relationship. The feed core 7 itself acts as a feeding rotation member, while the takeup core 9** itself acts as a takeup rotation member.

A slip ring 10 formed of rubber is interposed between an end surface of the feed core 7 and an end surface of the takeup core 9 to act as a friction member. An interlock mechanism 13 has a coil spring 11 mounted peripherally of a shaft portion **9*b* to exert an axial biasing force, with the takeup core 9 rotatable with rotation of the feed core 7 through a frictional force between the feed core 7 and slip ring 10 and a frictional force between the slip ring 10 and takeup core 9. In order that the used transfer tape 2 may be reliably taken up in a tight condition by the takeup core 9 despite a difference between a tape winding diameter of the feed core 7 and a tape winding diameter of the takeup core 9, the winding diameter of the takeup core 9 is formed larger than the winding diameter of the feed core 7 to set a used tape takeup peripheral speed of the takeup core 9 to be greater than a tape feeding peripheral speed of the feed core 7**.

Eight ridges 12 are formed to extend radially equidistantly on the surface of the takeup core 9 opposed to the slip ring 10. The slip ring 10 is sandwiched to contact the takeup core 9 linearly along these ridges 12.

This embodiment may be constructed as follows:

(j) The feeding rotation member may be formed integrally with or separately from the feed core as long as it is included in the interlock mechanism.

(k) The takeup rotation member may be formed integrally with or separately from the takeup core as long as it is included in the interlock mechanism.

(l) The friction member may be sandwiched to contact only the takeup rotation member linearly along radial directions in a plurality of positions circumferentially thereof.

(m) The friction member may be arranged rotatable with the takeup rotation member or feeding rotation member.

(n) Although the transfer tape is a pressure sensitive transfer tape in the embodiment, it may be a heat sensitive transfer tape.

(o) The transfer paint film formed on the transfer tape is not limited to a transfer paint film for correcting prints, but may, for example, be one used simply for coloring, or may be a binder to be applied to paper or the like.

A further embodiment will be described.

Figure 20:
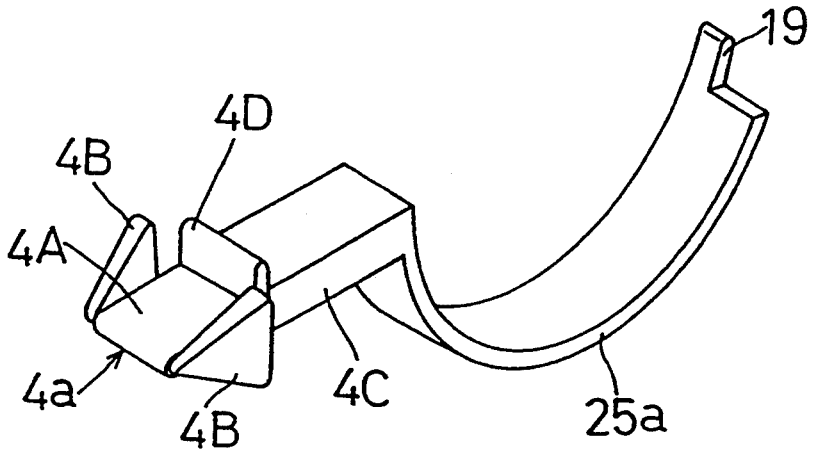
FIG. 20 is a perspective view of a principal portion.
Figure 21:
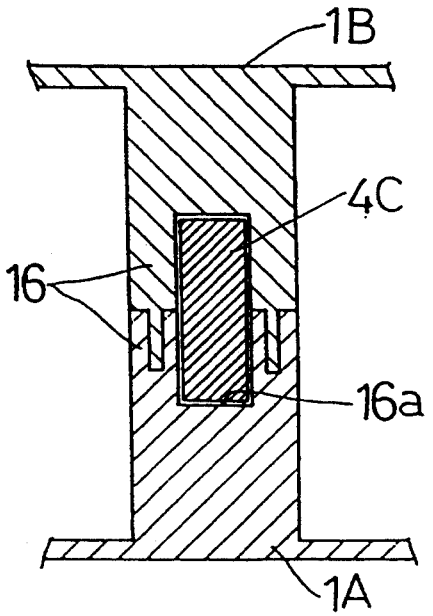
FIG. 21 is a sectional view taken on line A—A of FIG. 17.

(p) As shown in FIG. 20, the transfer head 4 in this embodiment includes a tape presser 4A having a tape pressing surface 4*a* for pressing transfer tape 2 continuously in the direction of width thereof, and a pair of side plates 4B having an approximately triangular shape as seen in the direction of width of the tape, which are formed integral to have an approximately H-shaped cross section. As shown in FIG. 21, a slidable shaft member 4C formed integral with the tape presser 4A is fitted in guide grooves 16*a* of guide members 16 formed in split case portions 1A, 1B. The slidable shaft member 4C is axially slidable along the guide grooves 16*a* to reciprocate along a direction to press the transfer tape 2.

Figure 17:
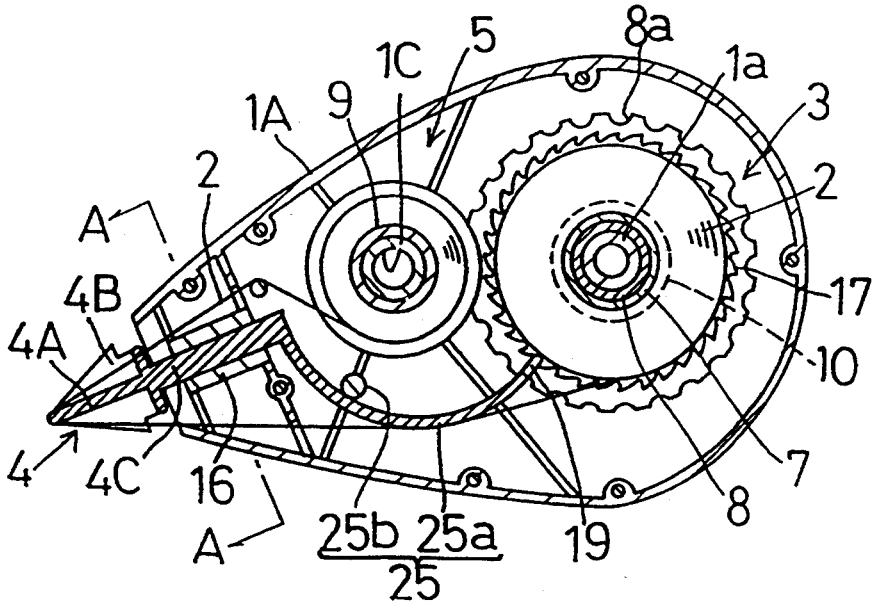
FIG. 17 is a plan view showing interior of a paint film transfer device in a still further embodiment.
Figure 18:
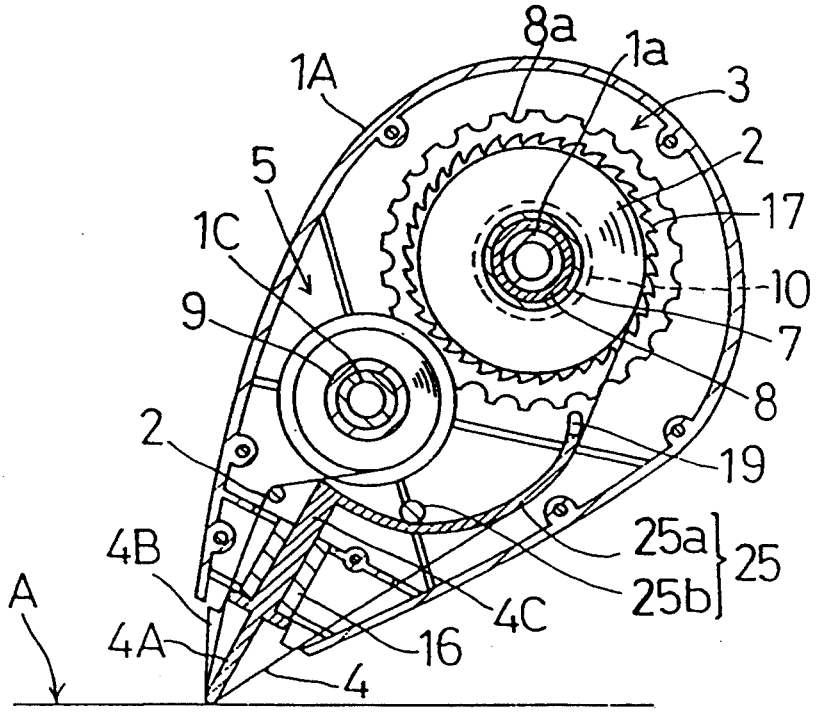
FIG. 18 is a plan view showing the interior of the paint film transfer device in use.
Figure 19:
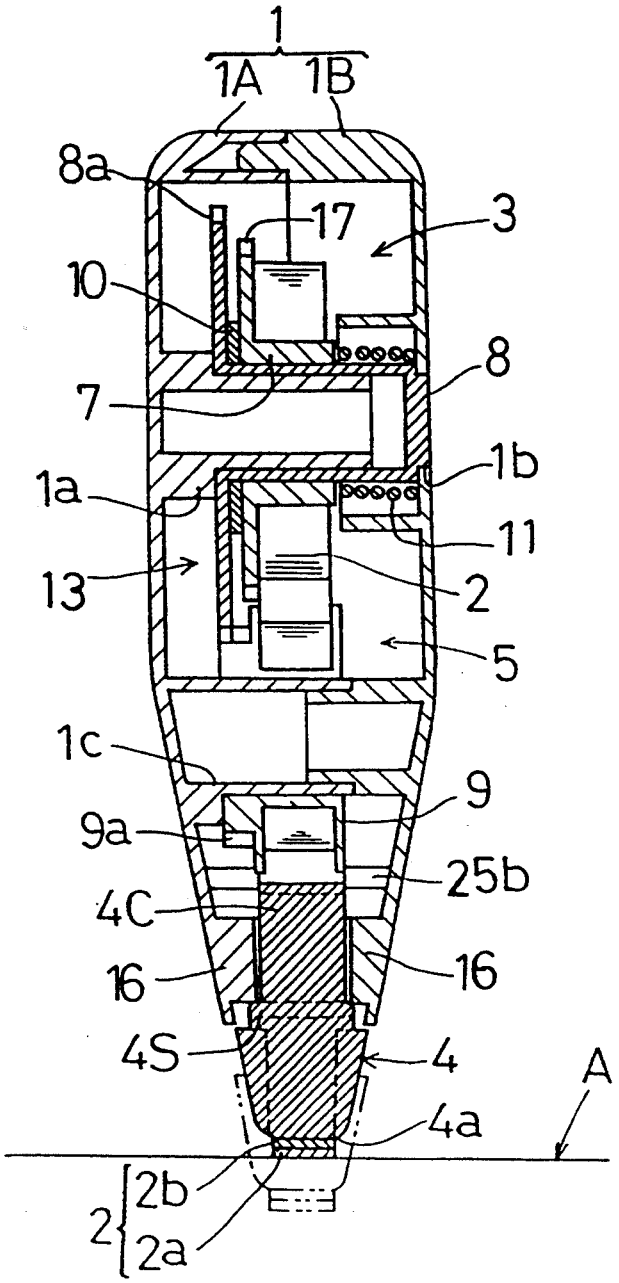
FIG. 19 is a sectional view showing the interior of the paint film transfer device.

As shown in FIGS. 17–19, a ratchet wheel 17 is formed integral with the feed core 7. A rotation stopper 19 for engaging this ratchet wheel 17 to stop rotation of the feed core 7 is provided to be movable between a rotation allowing position to allow rotation of the feed core 7 and a rotation stopping position to stop rotation thereof. Further, an interlock mechanism 25 is provided to move the rotation stopper 19 to the rotation allowing position in response to a pressing operation of the transfer head 4 toward the receiving surface A upon start of transfer operations, and to move the rotation stopper 19 to the rotation stopping position in response to a release operation to release the pressure of the transfer head 4 toward the receiving surface A upon completion of a series of transfer operations.

The interlock mechanism 25 includes a resilient arcuate arm 25*a* interconnecting the rotation stopper 19 and slidable shaft member 4C, and a contact member 25*b* for contacting the arcuate arm 25*a* to elastically and flexibly displace the arcuate arm 25*a* when the slidable shaft member 4C slides inwardly of the case. The arcuate arm 25*a* is formed integral with the rotation stopper 19 and slidable shaft member 4C. The contact member 25*b* is formed integral with the split case portions 1A, 1B.

When the slidable shaft member 4C slides inwardly of the case as a result of a pressing operation of the transfer head 4 toward the receiving surface A upon start of transfer operations, the arcuate arm 25*a* is elastically and flexibly displaced through contact with the contact member 25*b*. Then, the rotation stopper 19 is moved to the rotation allowing position disengaged from the ratchet wheel 17 to allow rotation of the feed core 7. When, in this state, the transfer head 4 is moved upstream with respect to the direction of tape feeding from the feed core 7, a tension is applied to the transfer tape 2 fed from the feed core 7 to produce a torque transmitted from the feed core 7 to the takeup core 9. When this torque transmitted reaches a certain torque (slip torque), slippage occurs between rotation of the feed core 7 and rotation of the takeup core 9 through a slip ring 10. As a result, the transfer tape 2 becomes unwound while forcibly rotating the feed core 7, and the transfer paint film 2*a* is applied and transferred to the receiving surface A under pressure of the transfer head 4. At the same time, the takeup core 9 is rotated with the rotation of the feed core 7 caused by feeding of the transfer tape 2, whereby the used transfer tape 2 having passed through the transfer head 4 is taken up on the takeup core 9.

An amount of inward movement of the slidable shaft member 4C moved inwardly of the case upon start of transfer operations is limited by contact between stoppers 4S formed integral with the slidable shaft member 4C and the guide members 16.

Further, the arcuate arm 25*a* elastically returns to an original posture as a result of a release operation to release the pressure of the transfer head 4 toward the receiving surface A upon completion of a series of transfer operations. The return movement of the arcuate arm 25*a* pushes the slidable shaft member 4C outwardly of the case, moving the rotation stopper 19 to the rotation stopping position to engage the ratchet wheel 17 and stop rotation of the feed core 7.

Upon start of the transfer operations, the transfer head 4 moves inwardly of the case, which relaxes the transfer tape 2 passed around the transfer head 4 outwardly of the case. However, the arcuate arm 25*a* elastically displaced through contact with the contact member 25*b* when the transfer head 4 presses the transfer tape 2 upon the receiving surface A, contacts an entire width of the backing material 2*b* of the transfer tape 2 in a position between the feed core 7 and transfer head 4, and outwardly presses the transfer tape 2, with the stoppers 4S and guide members 16 contacting each other. This pressing action applies a tension to the transfer tape 2, and efficiently eliminates the relaxation of the unused transfer tape 2 occurring upon start of the transfer operations.

Figure 22:
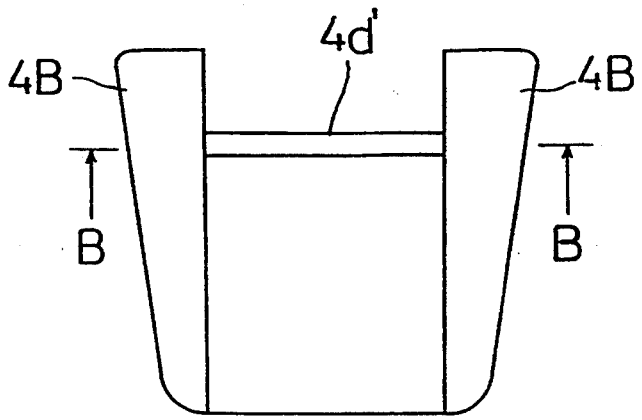
FIGS. 22 (*a*), (*b*) are an enlarged front view of a transfer head in a still further embodiment, and a sectional view thereof taken on line B—B.
Figure 22:
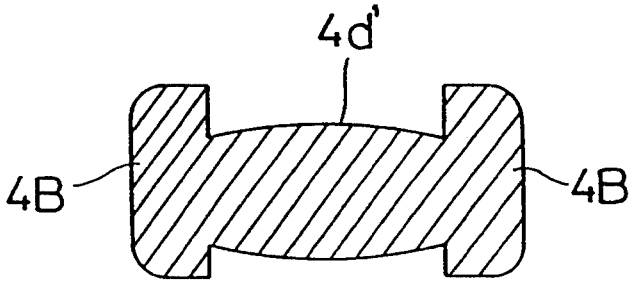
Figure 23A:
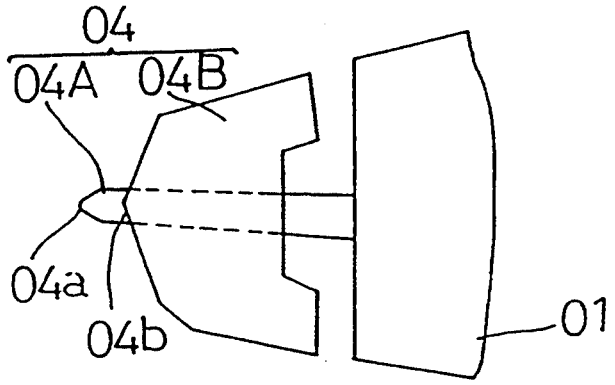
FIG. 23(a) (PRIOR ART)
FIGS. 23 (*a*), (*b*) are a side view showing a conventional transfer head, and a perspective view thereof.
Figure 23B:
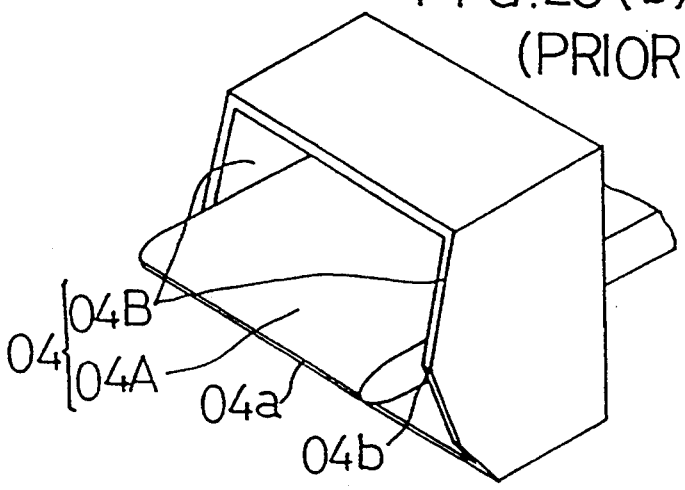
FIG. 23(b) (PRIOR ART)
Figure 24:
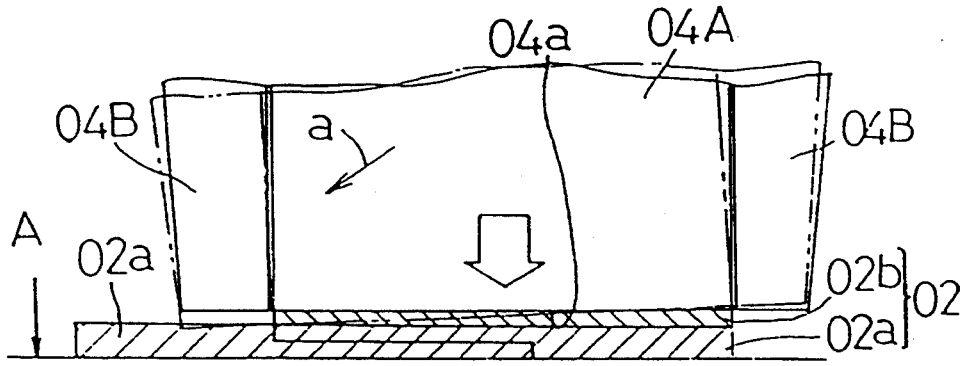
FIG. 24 (PRIOR ART)
FIG. 24 is a principle view showing a conventional superposing transfer condition.

(q) As shown in FIGS. 22 (*a*), (*b*), the paint film transfer device according to the present invention may include a transfer head defining a rib 4*d'* bulging in a middle position in the direction of width thereof.

With this construction, the tape may effectively be prevented from meandering, to stabilize running of the tape at all times, thereby providing the advantage of good transfer efficiency.

(R) The paint film transfer device according to the present invention may include belt interlocking between the transfer tape 2 and feed reel 8, in place of the gear transmission. That is, a takeup-side pulley is formed integral or rotatable with the takeup core, a feed-side pulley is formed integral or rotatable with the feed core, and a rubber belt acting as a circulating endless body is passed around the two pulleys. In this case, the rubber belt circulates in frictional contact with the two pulleys to act as frictional transmission means.

(S) The paint film transfer device according to the present invention may transfer to a receiving surface a coloring pressure sensitive paint film to be used for correcting characters and the like.

(T) The rotation stopper may be movable between a rotation stopping position to stop rotation of the feed core by engaging an interlocked rotation member rotatably interlocked with the feed core, and a rotation allowing position to allow rotation of the feed core by disengaging from the interlocked rotation member.

(U) The paint film transfer device according to the present invention may have a ratchet wheel formed integral with the takeup core rotatably interlocked to the feed core, with the rotation stopper movable between a rotation stopping position to stop rotation of the feed core by engaging this ratchet wheel, and a rotation allowing position to allow rotation of the feed core by disengaging from the ratchet wheel.

We claim:

1. A paint film transfer device having, mounted in a case (1), an unused tape storage (3) for feedably storing a transfer tape (2) having a transfer paint film (2*a*) formed on one surface of a backing material (2*b*), and a transfer head (4) for pressing on the backing material (2*b*) of the transfer tape (2) fed from the unused tape storage (3) out of the case (1) to transfer the transfer paint film (2*a*) of the transfer tape (2) to a receiving surface (A), wherein said transfer head (4) includes a tape presser (4A) having a tape pressing surface (4*a*) of a width approximately corresponding to a width of said transfer tape (2), and a pair of left and right side plates (4B) for limiting sideways movement of a transfer tape portion contacting the tape presser (4A), the tape pressing surface (4*a*) of said tape presser (4A) and tip end surfaces (4*b*) of said side plates (4B) defining a continuous or nearly continuous surface extending in a direction of width of the tape, the tip end surfaces (4*b*) of said side plates (4B) being inclined laterally outwardly of the tape and away from an imaginary straight line (X) extending in the direction of width of the tape through said tape pressing surface (4*a*).

2. A paint film transfer device as defined in claim 1, wherein each of the tip end surfaces (4*b*) of said side plates (4B) is linearly inclined laterally outwardly of the tape and away from an imaginary straight line extending in the direction of width of the tape through said tape pressing surface (4*a*).

3. A paint film transfer device as defined in claim 1, wherein said transfer head (4) is inflexibly and rigidly fixed to said case (1), and an elastic pressing portion (6) elastically deformable under a pressing force applied during transfer is provided at least in a position corresponding to the tape pressing surface (4*a*) of said transfer head (4).

4. A paint film transfer device as defined in claim 3, wherein said elastic pressing portion (6) is formed of an elastomer material.

5. A paint film transfer device as defined in claim 3, wherein said elastic pressing portion (6) is formed on an outer surface portion of said tape presser (4A) extending from a tip end position corresponding to the tape pressing surface (4*a*) to a rib (4*d*), (4*d'*).

6. A paint film transfer device as defined in claim 3, wherein said elastic pressing portion (6) is formed only on an outer surface portion of said tape presser (4A).

7. A paint film transfer device as defined in claim 3, wherein said tape presser (4A) has a tip end formed cylindrical, and said elastic pressing portion (6) has a C-shaped cross section and is secured to the cylindrical tip end of said tape presser (4A) by fitting means.

8. A paint film transfer device as defined in claim 3, wherein said transfer head (4) includes a tip end (4E) formed cylindrical and having a diameter slightly larger than a thickness of a plate-like proximal portion (4D) continuous with the tip end (4E), said elastic pressing portion (6) being an integrally molded member including a tubular portion (6A) having an approximately C-shaped vertical section for fitting on said cylindrical tip end (4E), a first side plate portion (6B) extending from one end of the C-shaped tubular portion (6A) along one side surface of the plate-like proximal portion (4D) of said transfer head (4), and a second side plate portion (6C) extending from the other end of said C-shaped tubular portion (6A) along the other side surface of said plate-like proximal portion (4D) to a greater extent than said first side plate portion (6B), said elastic pressing portion (6) being fitted on said transfer head (40 from the cylindrical tip end (4E) toward said plate-like proximal portion (4D).

9. A paint film transfer device as defined in claim 3, wherein said transfer head (4) includes a pair of left and right side plates (4B), and three mounting plates (4G) formed integral with one of the side plates (4B) and arranged approximately in a shape of C with spaces thereamong, said elastic pressing portion (6) being in form of a bulge, said elastic pressing portion (6) being fitted and secured to said three mounting plates (4G) of said transfer head (4) in the direction of width of the tape.

10. A paint film transfer device as defined in claim 1, wherein said transfer head (4) includes a plate-like tape presser (4A) having a rib (4*d*), (4*d'*) and a pair of side plates (4B) having an approximately triangular shape as seen in the direction of width of the tape.

11. A paint film transfer device as defined in claim 1, wherein said transfer head (4) includes a plate-like tape presser (4A) defining a rib (4*d'*) bulging in a middle position in a direction of width thereof.

12. A paint film transfer device having, mounted in a case (1), an unused tape storage (3) for feedably storing a transfer tape (2) having a transfer paint film (2*a*) formed on one surface of a backing material (2*b*), and a transfer head (4) for pressing on the backing material (2*b*) of the transfer tape (2) fed from the unused tape storage (3) out of the case (1) to transfer the transfer paint film (2*a*) of the transfer tape (2) to a receiving surface (A), said paint film transfer device comprising:

a feed core (7) on which transfer tape (2) is wound, a takeup core (9) for taking up said transfer tape (2) fed from said feed core (7), and an interlock mechanism (13) having a friction member (10) to rotate said feed core (7) with said takeup core (9), wherein said takeup core (9) has a takeup peripheral speed greater than a feeding peripheral speed of said feed core (7), with said feed core (7) rotatable relative to said takeup core (9) through slipping between at least one of said friction member (10) and said feed core (7), and said friction member (10) and said takeup core (9), said friction member (10) being positioned to contact at least one of the opposed surfaces of said feed core (7) and said takeup core (9) linearly in radial directions and in a plurality of positions circumferentially thereof.

13. A paint film transfer device as defined in claim 12, wherein ridges are formed to extend radially in tangential directions on a surface of at least one of said feed core (7) and said takeup core (9) and opposed to said friction member (10), with said friction member (10) being positioned between said feed core (7) and said takeup core (9).

14. A paint film transfer device as defined in claim 12, wherein said feed core (7) and said takeup core (9) are supported on a common axis.

15. A paint film transfer device as defined in claim 12, further including a feed reel (8) interlocked with said takeup core (9), wherein said interlock mechanism (13) causes said friction member (10) to be positioned between said feed core (7) and said feed reel (8) to rotate said feed core (7) with said feed reel (8) and said takeup core (9) under a frictional force exerted by said friction member (10), wherein said feed core (7), said friction member (10) and said feed reel (8) are supported on a common axis with said feed core (7) rotatable relative to said feed reel (8) and said takeup core (9) through slipping between at least one of said friction member (10) and said feed core (7), and said friction member (10) and said feed reel (8), and wherein said friction member (10) is positioned to contact at least one of the opposed surfaces of said feed core (7) and said feed reel (8) linearly in radial directions and in a plurality of positions circumferentially thereof.

16. A paint film transfer device as defined in claim 15, wherein ridges are formed to extend radially in tangential directions on a surface of at least one of said feed core (7) and said feed reel (8) and opposed to said friction member (10), with said friction member (10) being positioned between said feed core (7) and said feed reel (8).

17. A paint film transfer device as defined in claim 16, further including a guide section (18) for twisting and guiding said transfer tape (2) fed from said feed core (7) via said transfer head (4) to said takeup core (9), wherein said feed core (7), said takeup core (9), and said guide section (18) are mounted within said case (1).

18. A paint film transfer device comprising a transfer tape (2) having a transfer paint film (2*a*) formed on one surface thereof, a feed core (7) on which said transfer tape (2) is wound in roll form, a transfer head (4) for pressing the transfer tape (2) fed from said feed core (7) on a receiving surface (A) to transfer said paint film (2*a*) to said receiving surface (A), a takeup core (9) for taking up in roll form the transfer tape (2) having passed through said transfer head (4), and an interlock mechanism (13) for slippably interlocking a rotation of said feed core (7) with a rotation of said takeup core (9) and rotating said takeup core (9) at a takeup speed faster than a feeding speed of said feed core (7), wherein said transfer head (4) is integrally formed with a shaft member (4*c*) and is movable in an upstream direction with respect to a direction of tape feeding from said feed core (7) when said transfer head (4) and said transfer tape (2) are pressed upon said receiving surface (A) and said shaft member (4*c*) slides when said transfer head (4) is moved, whereby the transfer tape (2) becomes unwound while rotating said feed core (7), the transfer tape (2) having passed through said transfer head (4) being taken up on said takeup core (9), said paint film transfer device further including a rotation stopper (19) movable between a rotation allowing position where said rotation stopper (19) is not engaged with said feed core (7) to allow rotation of said feed core (7) and a rotation stopping position where said rotation stopper (19) is engaged with said feed core (7) to stop rotation of said feed core (7), and an interlock mechanism (25) to move said rotation stopper (19) to the rotation allowing position in response to a pressing operation of said transfer head (4) toward said receiving surface (A) upon start of a transfer operation, and to move said rotation stopper (19) to the rotation stopping position in response to a release operation to release the pressure of the transfer head (4) toward the receiving surface (A).

19. A paint film transfer device as defined in claim 18, wherein said interlock mechanism (25) includes a resilient arcuate arm (25*a*) interconnecting said rotation stopper (19) and a slidable shaft member (4C), and a contact member (25*b*) for contacting said arcuate arm (25*a*) to elastically and flexibly displace the arcuate arm (25*a*) when said slidable shaft member (4C) slides inwardly of the case, said arcuate arm (25*a*) being formed integral with said rotation stopper (19) and said slidable shaft member (4C), while said contact member (25*b*) is formed integral with split case portions (1A), (1B).

20. A paint film transfer device as defined in claim 18, wherein said rotation stopper (19) engages a ratchet wheel (17) when said rotation stopper (19) is in said rotation stopping position, and said ratchet wheel (17) is integrally formed with said feed core (7).

* * * * *

UNITED STATES PATENT AND TRADEMARK OFFICE

CERTIFICATE OF CORRECTION

PATENT NO. : 5,430,904

DATED : July 11, 1995

INVENTOR(S) : Masahiko Ono and Yoshinobu Yamashita

It is certified that error appears in the above-indentified patent and that said Letters Patent is hereby corrected as shown below:

Title page, delete "[22] Filed: Mar. 30, 1994" and insert

--[22] PCT Filed: Oct. 1, 1992
[86] PCT No.: PCT/JP92/01271
§ 371 Date: Mar. 30, 1994
§ 102(e) Date: Mar. 30, 1994
[87] PCT Pub. No.: WO93/07009
PCT Pub. Date: Apr. 15, 1993--.

Column 1 Line 40 "pans" should read --parts--.

Column 5 Line 53 "tom" should read --torn--.

Column 6 Line 5 "(*a*) , (*b*)" should read --(*a*), (*b*)--.

Column 7 Line 33 "slip ring 10 friction member, such as" should read --friction member, such as slip ring 10--.

UNITED STATES PATENT AND TRADEMARK OFFICE

CERTIFICATE OF CORRECTION

PATENT NO. : 5,430,904

DATED : July 11, 1995

INVENTOR(S) : Masahiko Ono and Yoshinobu Yamashita

It is certified that error appears in the above-indentified patent and that said Letters Patent is hereby corrected as shown below:

Column 9 Lines 62-63 "plate-like-proximal" should read --plate-like proximal--.

Column 10 Line 61 "fiat" should read --flat--.

Signed and Sealed this

Twenty-sixth Day of December, 1995

*Attest:*

BRUCE LEHMAN

*Attesting Officer*

*Commissioner of Patents and Trademarks*